United States Patent [19]

Ferretti

[11] Patent Number: 4,459,774

[45] Date of Patent: Jul. 17, 1984

[54] HAND WEAPON CALIBER REDUCERS

[76] Inventor: Serge Ferretti, La Fabrigoule Saute Yrargues, 34270 Saint Mathieu de Treviers, France

[21] Appl. No.: 359,904

[22] Filed: Mar. 19, 1982

[30] Foreign Application Priority Data

May 5, 1981 [FR] France ..... 81 08860

[51] Int. Cl.[3] ..... F41C 21/10

[52] U.S. Cl. ..... 42/77

[58] Field of Search ..... 42/77, 59; 102/446

[56] References Cited

FOREIGN PATENT DOCUMENTS 2465182 3/1981 France .

99973 2/1923 Switzerland .

210270 1/1924 United Kingdom .

*Primary Examiner*—Charles T. Jordan

*Assistant Examiner*—Ted L. Parr

*Attorney, Agent, or Firm*—Young & Thompson

[57] ABSTRACT

The present invention relates to a caliber reducer for hand weapon.

The caliber reducer comprises a caliber reducing tube 13 with a boring 14 the axis B'-B' of which is situated in the barrel boring diametral plane passing by the line of sight of the weapon and is characterized in that the reducing tube boring axis B-B' diverges relative to the barrel axis A-A in the direction of the muzzle.

The object of the invention is to preserve the holding of the weapon despite the suppression of the kick due to the reduced caliber, by compensating for the divergence of the line of sight.

6 Claims, 9 Drawing Figures

HAND WEAPON CALIBER REDUCERS

Field of the Invention

This invention relates to hand weapon caliber reducers, particularly but non exclusively for central percussion hand weapons adapted for firing peripheral percussion cartridges. It relates more particularly, amongst hand weapons, to revolvers, the reducer comprising on the one hand a reducing tube adapted for being introduced into the barrel and on the other hand an interchangeable cylinder.

Background of the Invention

A reducer of said type is disclosed for example in French Patent Application no. 79 22419 of Sept. 7, 1979 in the name of the Applicant. The hand weapon caliber reducers belong to two types. One which is particularly adapted to revolvers comprises a reducing tube with axial boring and a cylinder in which the axes of the chambers are arranged according to a frustoconical surface where the diameter of the circle in the cylinder rear face is greater than the diameter of the circle passing through the chamber axes of the weapon original cylinder by about the caliber of the cartridge of reduced caliber. The other which applies to single shot weapons comprises a reducing tube the boring of which is eccentric by about half the caliber of the cartridge of reduced caliber. In both cases, the boring the axis of the reducing tube is parallel to the borehole axis of the barrel. In the case of reducing tubes with eccentric boring, devices are also known for maintaining the boring axis of the reducing tube in the diametral plane passing through the line of sight called plane of fire. The invention could also be applied to reducers for firing central percussion cartridges.

However, large caliber hand weapons offer the characteristic of having a line of sight compensated for the recoil or kick of the weapon. Since the kick of the weapon results in a "jump" of the barrel, the line of sight diverges relative to the barrel axis. When the weapon is used with reduced caliber ammunitions, the kick is greatly reduced and becomes even practically non existent. British Pat. No. 210,270 of Jan. 17, 1923 offers a remedy therefor by providing the reducing tube with a special back sight for the cartridges of smaller caliber, said back sight being rigidly connected to the centering flange of the reducing tube. However, such a solution has a disadvantage with weapons used with a reducer for training shooting because the modification of the line of sight brings about a modification of the hold of the weapon which, even though small, has an influence on the aiming accuracy.

Object and Summary of the Invention

The object of the present invention is to remedy such a disadvantage and its object is a caliber reducing tube for hand weapons comprising a boring the axis of which is situated in the barrel boring diametral plane passing through the weapon line of sight, characterized in that the reducing tube boring axis diverges relative to the barrel axis in the direction of the muzzle.

According to a practical embodiment, the angle of divergence of the reducing tube boring axis is substantially equal to the line of sight divergence for the weapon in consideration.

The reducing tube boring axis intersects the barrel boring axis, so-called weapon line of fire, which is also the axis of the outer bearing surface of the reducing tube, at some point on the tube length. However, since the recessing axis which is oblique relative to the line of fire has to be linked up with the reducing tube axis via a curve corresponding to the line formed by the centres of the curved boring, it is preferable to locate the line of intersection as much as possible to the rear and preferably between the cylinder and the barrel. However, a compromise has to be reached in the case of long reducing tubes in order to leave a sufficient quantity of metal at the muzzle of said tube.

According to an embodiment and for reducing the transition curve, the recessing axes are located in the cylinder so as to diverge towards the barrel. With such an arrangement and instead of the angle formed by the two axes to be linked up being the sum of the angles of divergence of the recessing and of the reducing tube boring, it becomes equal to their difference. This preferential arrangement can however offer difficulties, particularly for making revolver cylinders, the cartridge coming then very close to the cylinder axis, thereby making the introduction of the cartridges difficult.

The cylinder recessings are bored obliquely relative to the cylinder axis. The cartridge is then struck at the end of an oblique diameter and the angle of deviation of the bullet is equal to the recessing angle of divergence which is slightly reduced.

Brief Description of the Drawings

Further features of the invention will become more apparent from the detailed description of several embodiments which are now given, with reference to the accompanying drawings wherein.

Detailed Description of the Embodiments

Figure 1:
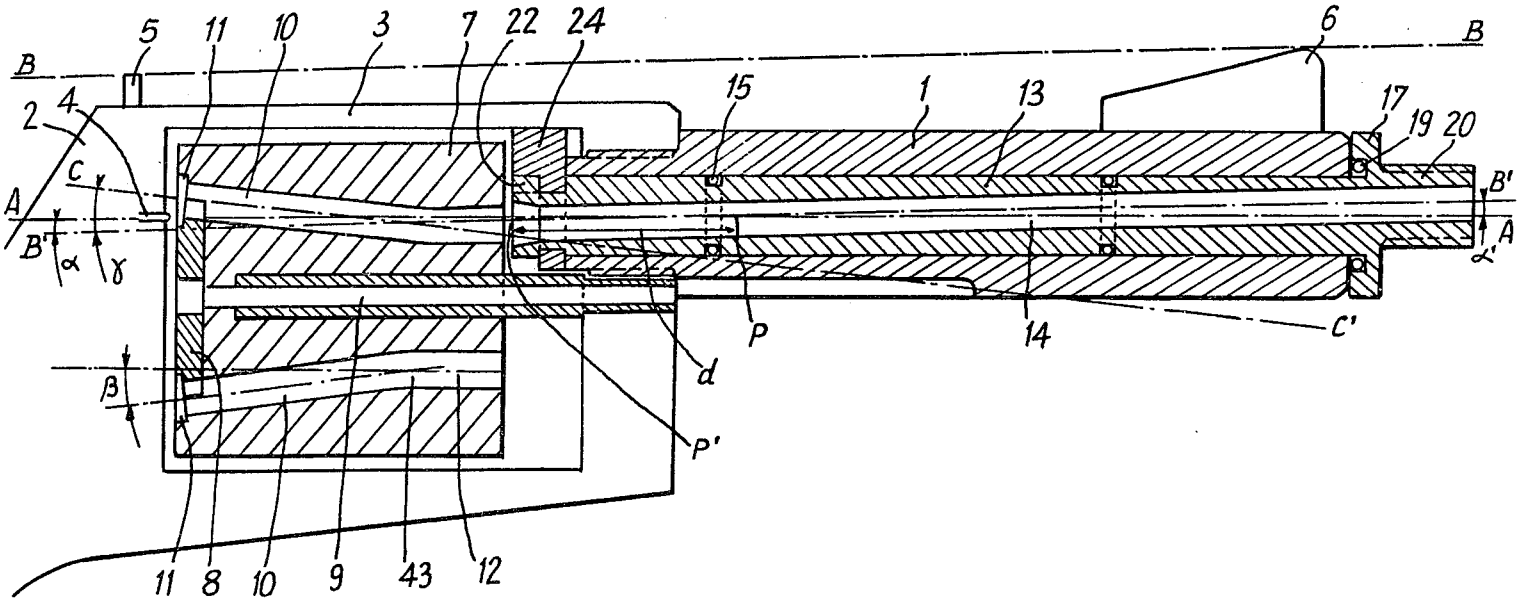
FIG. 1 is a schematic axial longitudinal sectional view of a revolver with a reducer according to the invention, as a first embodiment.
Figure 2:
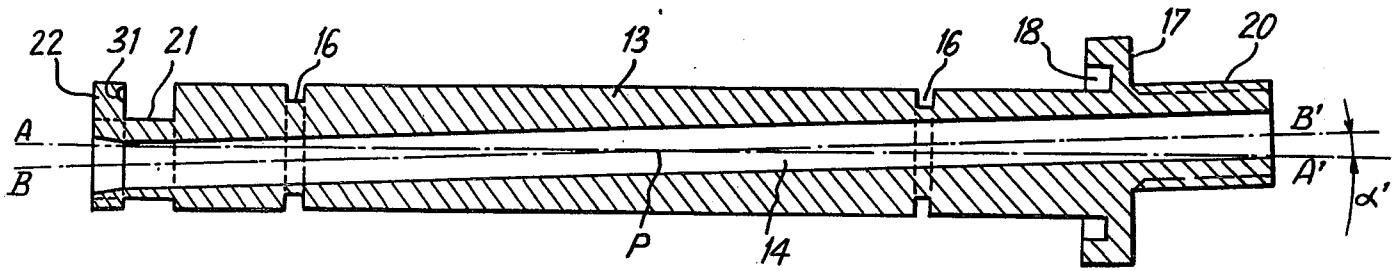
FIG. 2 is a longitudinal sectional view of the reducing tube of FIG. 1.
Figure 5:
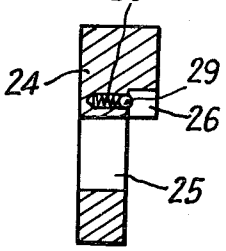
FIG. 5 is a sectional view of FIG. 4.
Figure 4:
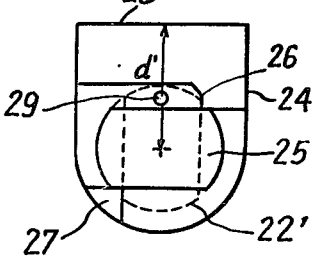
FIG. 4 is an elevation view of the positioning and locking part of the reducing tube of FIG. 1.
Figure 3:
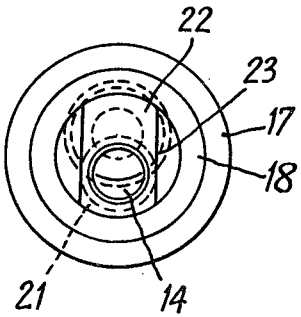
FIG. 3 is a left end view of FIG. 2.

In the drawings, reference numeral 1 designates the barrel of the weapon, 2 the body, 3 the junction band between the barrel and the body, 4 the striker or hammer, 5 the sighting notch, 6 the foresight. This type of revolver is used by way of example, but the invention applies also to tilting barrel revolvers and to pistols. Line A-A is the original barrel boring axis and line B-B the line of sight. As explained hereabove and in order to compensate for the kick of the weapon, axis A-A of the barrel boring and line of sight B-B form an angle $\alpha$ therebetween, which can be of the order of one degree or more.

The reducing device comprises in known manner a cylinder 7 substituted for the original cylinder with an extractor plate 8 operated by an extractor push-piece 9 along the axis of the cylinder, and chambers 10 arranged along a conical nappe so that the peripheral portion of the bead 11 comes in coincidence with the extractor. The chambers extend into a curved junction 12. The reducing device comprises also a reducing tube 13 with a boring 14.

According to the invention, axis B'-B' of the reducing tube boring forms, with the axis A-A of the barrel boring, an angle $\alpha'$ which is substantially equal to angle $\alpha$, said angle $\alpha'$ being in the vertical plane and turned upwards.

The two axes A-A and B'-B' intersect at a point P which, in the case of a cylinder with convergent recessings, is as close as possible to the rear end of the reducing tube. In fact, the intersection point P' between the outlet of the recessing curved section and the reducing tube boring axis is eccentric by d tan $\alpha'$, wherein d is the distance between points P and P', and this throwing off center has to be corrected by increasing angle $\beta$ in the case of convergent recessings, while it reduces angle $\beta$ in the case of the divergent recessings of FIG. 6.

The reducing tube can be mounted and locked in position in the barrel by any known means comprising at least one positioning means in the vertical plane or firing plane of the reducing tube boring axis.

In the two embodiments, the reducing tube is centered in the barrel boring via joints 15 received in grooves 16. In the embodiment of FIGS. 1 to 5, the reducing tube comprises at its front end a flange 17 with, on its rear face, a groove 18 in which is mounted a resilient joint forming a spring 19. The end of the reducing tube is threaded at 20 for receiving a silencer. At its rear end, the reducing tube is formed with an off center cylindrical bearing surface 21 and an end flange 22 comprising two flat parts 23. The positioning and locking of the reducing tube are provided by a part 24 having a window 25 the section of which corresponds to that of the shoulder 22 and two abutments 26–27 diametrically opposite at the top sideways and at the bottom sideways relative to the window. The distance d' from the window centre to the planar upper surface of part 24 corresponds to the distance between axis A-A and the lower face of band 3. The reducing tube is therefore inserted into the barrel via the horizontal flat parts 23 of flange 22, and part 24 is placed between the cylinder and the barrel by bearing on the rear end of the barrel and against band 3. The flange 22 extends through windows 25 in order to be behind part 24, by compressing joint 19. The barrel is then turned over a quarter of a turn and the shoulder reaches the position 22' shown in phantom in FIG. 4, the reducing tube plane of fire being coincident with the weapon plane of fire. The locking can be provided by a close fit with mating shapes of part 24 by forming a protrusion on respectively the front face of flange 22 and the rear face of part 25, the return to position being ensured by the compressed joint 19, but one can also use a ball 29 crimped in a housing of part 24 and biased by a spring 30, and a housing 31 in the front face of flange 22.

Figures 6, 7, 8, 9:
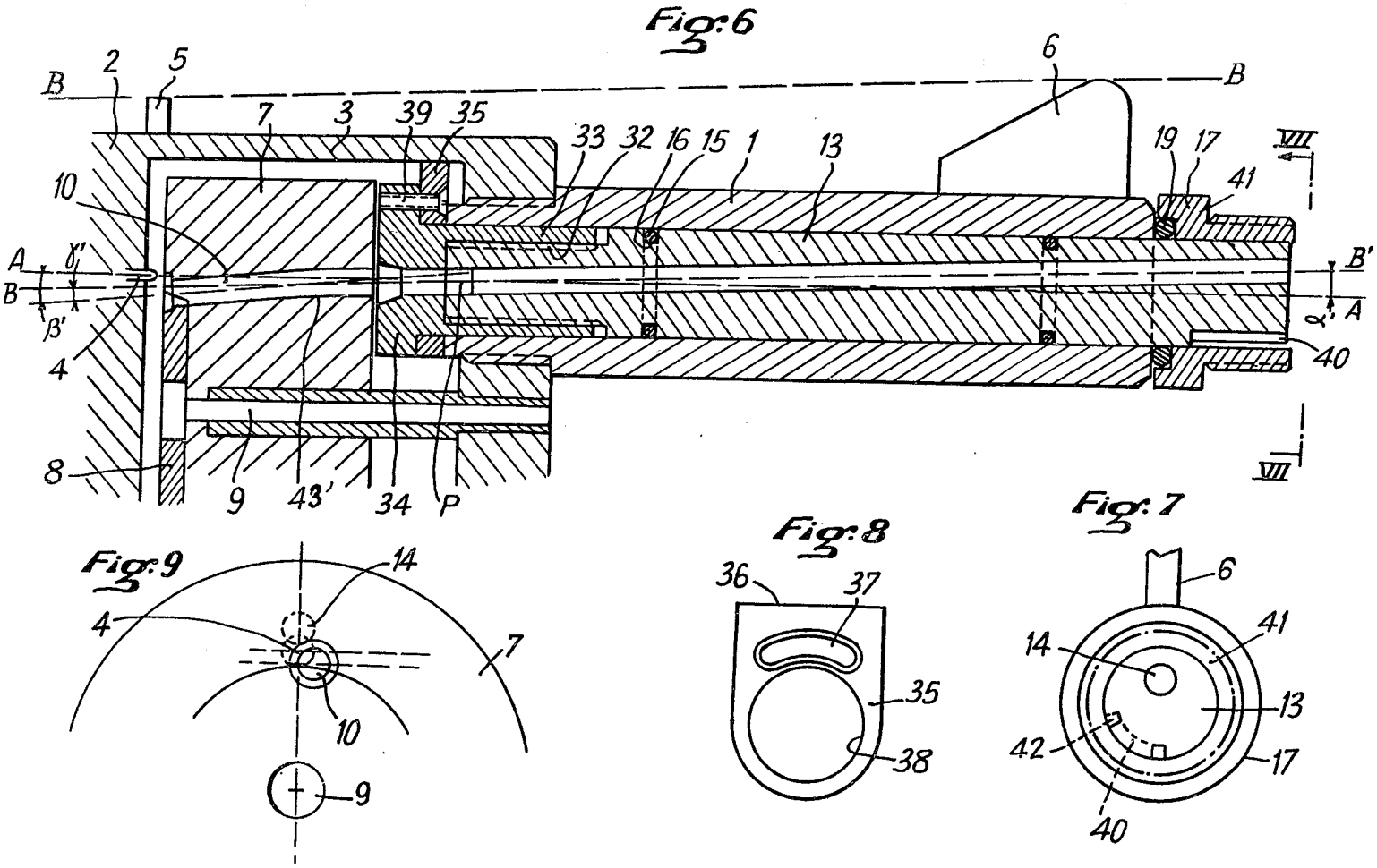
FIG. 6 is a view corresponding to FIG. 1 of a second embodiment.
FIG. 7 is an end view along line VII-VII of FIG. 6.
FIG. 8 is an elevation of the positioning plate of the plug on the cylinder side in FIG. 6.
FIG. 9 is a rear elevation view of a part corresponding to an alternative embodiment of a recessing of a cylinder.

In the embodiment of FIGS. 6 to 8, the reducing tube is fixed in position by having the rear end of the reducing tube threadedly engaged at 32 into a blind sleeve 33 formed to the rear in a flange 34. A part 35 is threaded onto the sleeve 33 and has a planar surface 36 adapted for coming to rest under band 3. Said part 35 is also formed with a slot 37 concentric with the orifice 38 through which extends the sleeve, a screw 39 extending through said slot for being screwed in flange 34. Such a mounting allows setting the position of the reducing tube plane of fire when thoroughly screwed into the blind sleeve 33. At its other end, the reducing tube is formed with a bayonet groove 40. A plug 41 formed with a flange 17, a groove 18 adapted for receiving a compression joint 19 and a threaded portion 20 provided for mounting the silencer, can be engaged on the protruding end of the reducing tube and is formed with an inner pin 42 engaging into the groove 40 for providing the bayonet locking.

In FIG. 1 of the drawings, the cylinder chambers 10 are arranged as disclosed in French Patent Application no. 79 22419 with their axis on a conical nappe tapering towards the front. The axes of the chambers form an angle $\beta$ equal to the half apex angle of the conical nappe, with the weapon axis, and therefore an angle $\gamma=\alpha'+\beta$ with the reducing tube boring axis. The curved connecting region 43 is therefore highly emphasized. In the embodiment of FIG. 6, the conical nappe is on the contrary divergent towards the front, the value of angle $\beta'$ being substantially less than that of $\beta$ due to the setting off center of point P' and due to the fact that angle $\gamma'$ is equal to $\gamma'=\beta-\alpha'$. This reduces the importance of the connecting region 43 '. However, the cartridge can be difficult to engage into a chamber the opening of which at the rear is close to the cylinder axis. In a solution shown in FIG. 9, the recessing 10 is no more provided in a diametral plane becoming coincident with the plane of fire, but obliquely, whereby the position can be that required with the proviso that the peripheral bead of the base passes by the hammer impact point 4. The recessing 10 and its connection can in particular have their line of centres in the plane containing the reducing tube boring axis B'-B' and perpendicular to the plane of fire. In this case, the recessing deviation angle $\gamma''$ relating to the reducing tube axis is equal $\beta$, the tangent of which is equal to the half caliber divided by the length of the recessing.

Various modifications can be applied to the embodiments described hereabove by way of examples, without departing from the scope of the appended claims.

I claim:

1. A caliber reducer for hand weapon, comprising a caliber reducing tube with a boring the axis B'-B' of which is situated in the barrel boring diametral plane passing by the weapon line of sight, characterized in that the reducing tube boring axis diverges upwardly relative to the barrel axis in the direction of the muzzle.

2. A caliber reducer according to claim 1, wherein the angle of divergence of the reducing tube boring axis is substantially equal to the divergence of the line of sight of the weapon in consideration.

3. A caliber reducer according to any one of claims 1 and 2, wherein the point of intersection of the reducing tube boring axis and the weapon barrel axis is set back as much as possible to the rear.

4. A caliber reducer according to any one of claims 1 to 3, for a revolver with a cylinder, having plural recessings therein wherein the axes of the recessings in the cylinder diverge towards the front.

5. A caliber reducer according to any one of claims 1 to 3, for an interchangeable cylinder revolver, wherein the recessings are bored obliquely relative to the cylinder axis.

6. A caliber reducer according to claim 1, for a revolver with a cylinder having plural recessings therein, wherein the axes of the recessings in the cylinder diverge towards the rear.

* * * * *